US007458501B1

(12) United States Patent
Pelleg

(10) Patent No.: US 7,458,501 B1
(45) Date of Patent: Dec. 2, 2008

(54) DOCUMENT CASE WITH RESILIENT EXPANDING FLAP

(75) Inventor: Roni Pelleg, Woodland Hills, CA (US)

(73) Assignee: Better Office Products, Inc., Chatsworth, CA (US)

( * ) Notice: Subject to any disclaimer, the term of this patent is extended or adjusted under 35 U.S.C. 154(b) by 829 days.

(21) Appl. No.: 11/081,256

(22) Filed: Mar. 15, 2005

Related U.S. Application Data

(60) Provisional application No. 60/554,087, filed on Mar. 17, 2004.

(51) Int. Cl.
*B65D 27/00* (2006.01)
*B65D 37/00* (2006.01)

(52) U.S. Cl. ..... 229/67.1; 229/67.3; 229/67.4

(58) Field of Classification Search ..... 229/67.1–67.4
See application file for complete search history.

(56) References Cited

U.S. PATENT DOCUMENTS 3,256,919 A * 6/1966 Ogletree ..... 224/610
3,312,384 A * 4/1967 Heynemann ..... 383/13
4,262,838 A * 4/1981 Mackenzie ..... 229/72
6,394,497 B1 * 5/2002 Ho ..... 281/29
6,607,122 B1 * 8/2003 Ong ..... 229/67.3
6,672,439 B2 * 1/2004 Platte, III ..... 190/103
7,147,142 B1 * 12/2006 Chang ..... 229/67.3
2006/0054669 A1 * 3/2006 Hsieh ..... 229/67.3
2006/0266807 A1 * 11/2006 Shook ..... 229/67.3
2007/0194090 A1 * 8/2007 Chou ..... 229/67.3

* cited by examiner

*Primary Examiner*—Jes F Pascua
(74) *Attorney, Agent, or Firm*—Blakely Sokoloff Taylor & Zafman

(57) ABSTRACT

A document case includes an expandable file module between two side panels. A flap may be coupled to a first side panel by a top panel. The top panel is resilient such that the top panel urges a second side panel toward the first side panel when the flap is secured to the second side panel to close the document case.

20 Claims, 2 Drawing Sheets

DOCUMENT CASE WITH RESILIENT EXPANDING FLAP

CROSS REFERENCE TO RELATED APPLICATIONS

This application claims the benefit of U.S. provisional application No. 60/554,087, filed Mar. 17, 2004.

SUMMARY OF THE INVENTION

A document case includes an expandable file module between two side panels. A flap may be coupled to a first side panel by a top panel. The top panel is resilient such that the top panel urges a second side panel toward the first side panel when the flap is secured to the second side panel to close the document case.

DETAILED DESCRIPTION OF THE INVENTION

Figure 1:
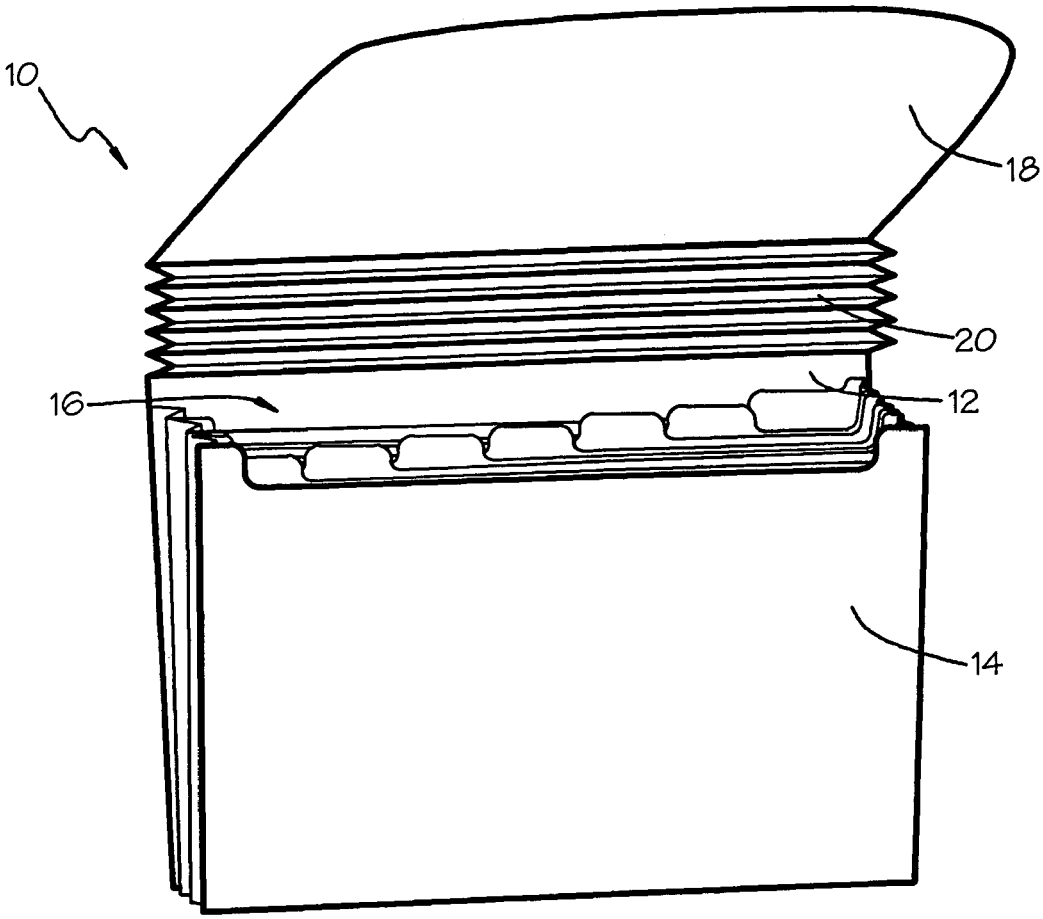
FIG. 1 is a pictorial view of a document case that embodies the invention.

FIG. 1 shows a document case 10 that embodies the invention. A first side panel 12 and a second side panel 14 each include exterior and interior surfaces. An expandable file module 16 is coupled to the interior surfaces of the first side panel 12 and the second side panel 14. The expandable file module 16 may include a plurality of interconnected pockets, which may provide storage for documents and the like.

A flap 18 is coupled to an edge of the first side panel 12 by a top panel 20. A portion of the flap 18 may be secured adjacent the exterior surface of the second side panel 14 to close the document case 10, as may be seen in FIG. 2. The top panel 20 may be coupled to an edge of the first side panel 12 and an edge of the flap 18. The top panel 20 is resilient such that the top panel urges the second panel 14 toward the first panel 12 when the flap 18 is secured to the second panel 14 to close the document case 10. The top panel 20 may be made from an elastomeric material such as rubber or plastic. The top panel 20 may be formed with accordion folds, such as the folds shown in FIG. 1, to enhance the resiliency of the top panel.

Figure 2:
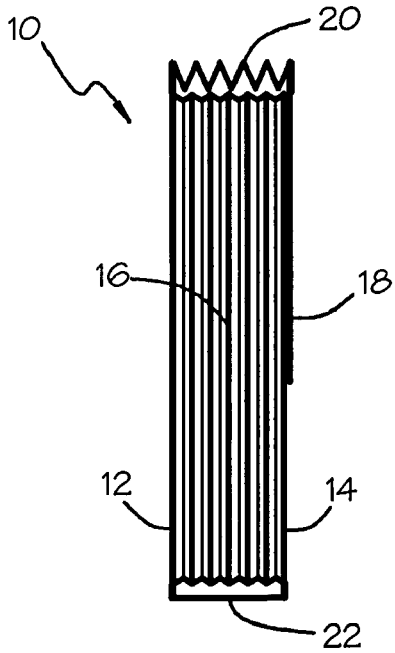
FIG. 2 is a side view of the document case of FIG. 1 in which the document case is relatively empty.
Figure 3:
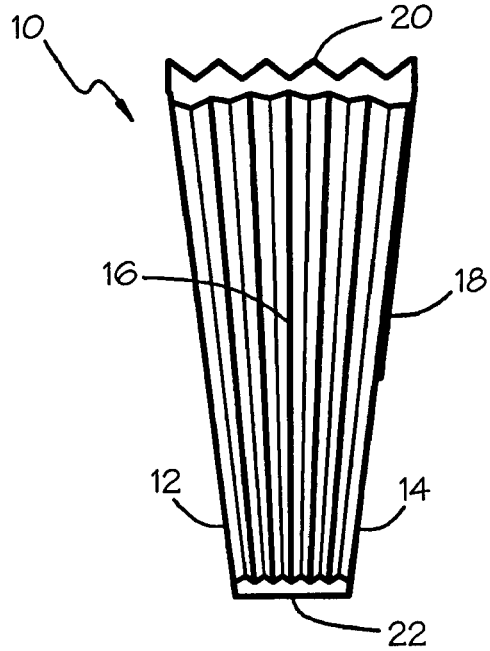
FIG. 3 is a side view of the document case of FIG. 1 in which the document case is relatively full.

The document case 10 may include a bottom panel 22 as shown in the side views of FIGS. 2 and 3. The bottom panel 22 may couple adjacent edges of the first side panel 12 and the second side panel 14 to hold the coupled edges in a spaced apart relationship. FIG. 2 shows the document case 10 in a relatively empty condition. FIG. 3 shows the document case 10 in a relatively full condition. It may be seen that the bottom panel 22 is not resilient and the edges coupled by the bottom panel may remain in a substantially fixed spaced apart relationship to one another.

Again referring to FIGS. 2 and 3, it may be seen that the resilient top panel 20 expands when the document case 10 is filled as shown in FIG. 3. Because the top panel 20 is resilient, the top panel urges the second panel 14 toward the first panel 12 when the flap 18 is secured to the second panel 14 to close the document case 10 causing the document case to assume a compact configuration as shown in FIG. 2 when the document case is relatively empty. The flap 18 may be removably secured to the second panel 14 by a fastener such as a snap fastener or a hook and loop fastener.

The document case 10 may be formed from a single sheet of material. The coupled edges of the bottom panel, first side panel, and the second side panel may be formed by folding the sheet.

Figure 4:
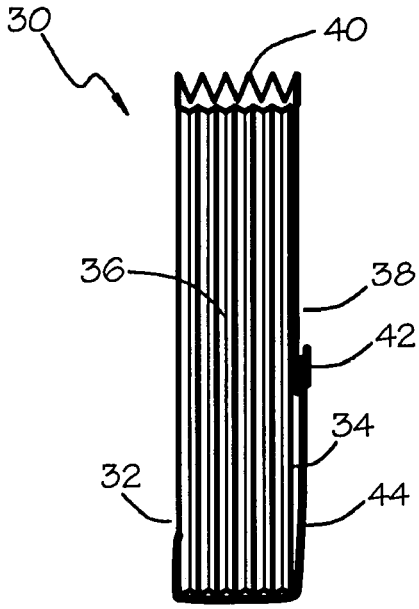
FIG. 4 is a side view of another document case that embodies the invention in which the document case is relatively empty.
Figure 5:
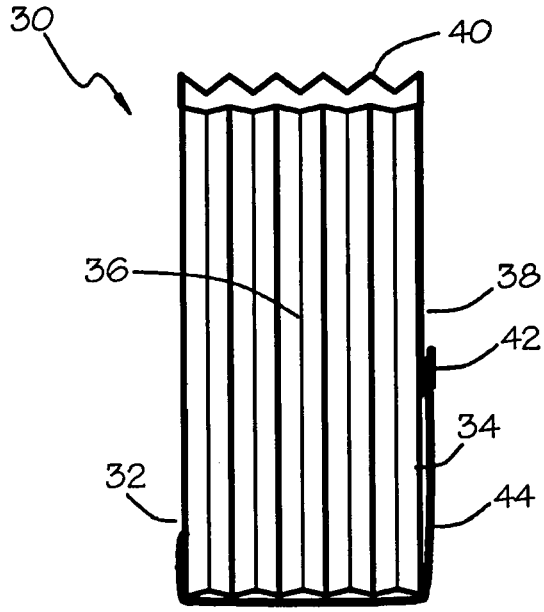
FIG. 5 is a side view of the document case of FIG. 4 in which the document case is relatively full.

FIGS. 4 and 5 show side views of another document case 30 that embodies the invention. The document case 30 includes a first side panel 32, a second side panel 34, an expandable file module 36, a flap 38, and a resilient top panel 40 that may be arranged in a similar manner to the document case 10 shown in FIGS. 1 through 3 and described above. The document case 30 may include an elastic band 44 to couple the flap 38 to the first side panel 32. The elastic band may pass over a bottom edge of the first side panel 32 opposite the edge to which the top panel 40 is coupled. The elastic band 44 may urge the second side panel 34 toward the first side panel 32 when the elastic band couples the flap 38 to the first side panel.

The document case 30 may include a button 42 coupled to the flap. The elastic band 44 may be coupled to the first side panel 32, such as by being passed through a hole in the first side panel and secured. The elastic band 44 may be removably coupled to the button 42, such as by having a loop portion that is passed over a shank portion of the button to be held between a larger head portion of the button and the flap 38.

The document case 30 may be closed on the bottom by the construction of the expandable file module 36. The bottom of the expandable file module 36 may be an accordion type construction that expands as the document case 30 is filled, as shown in FIG. 5. The resilient top panel 40 and the elastic band 44 may cooperate to urge the second panel 34 toward the first panel 32 when the flap 38 is secured by the elastic band to close the document case 10 causing the document case to assume a compact configuration as shown in FIG. 4 when the document case is relatively empty. Compared to the document case 10 shown in FIGS. 1 through 3, the document case 30 shown in FIGS. 4 and 5 may permit the expandable file module 36 to expand more fully and accommodate a larger quantity of documents.

Figure 6:
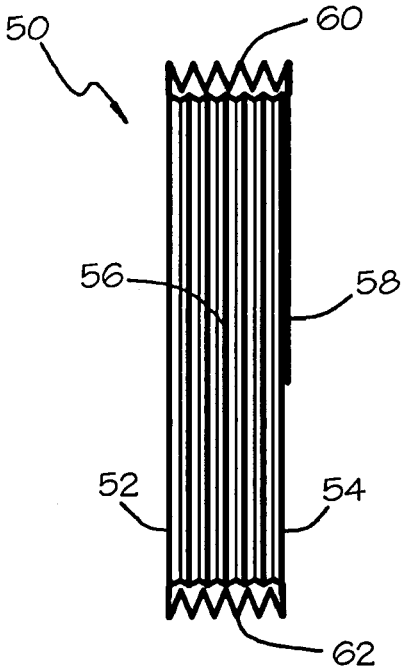
FIG. 6 is a side view of another document case that embodies the invention in which the document case is relatively empty.
Figure 7:
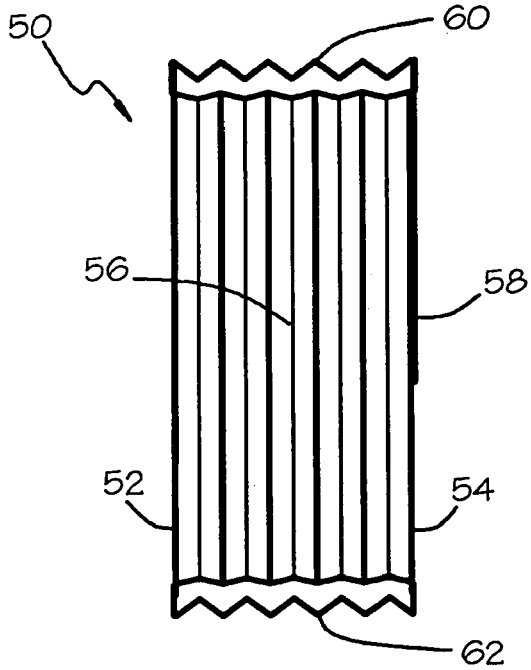
FIG. 7 is a side view of the document case of FIG. 6 in which the document case is relatively full.

FIGS. 6 and 7 show side views of another document case 50 that embodies the invention. The document case 50 includes a first side panel 52, a second side panel 54, an expandable file module 56, a flap 58, and a resilient top panel 60 that may be arranged in a similar manner to the document case 10 shown in FIGS. 1 through 3 and described above. The flap 58 may be removably secured to the second panel 54 by a fastener such as a snap fastener or a hook and loop fastener.

The document case 50 may include a resilient bottom panel 62 to couple adjacent edges of the first side panel 52 and the second side panel 54 to urge the second side panel toward the first side panel at the coupled edges. The bottom panel 62 may be made from an elastomeric material such as rubber or plastic. The bottom panel 62 may be formed with accordion folds, such as the folds shown in FIG. 6, to enhance the resiliency of the bottom panel. The resilient top panel 60 and bottom panel 62 may cooperate to cause the document case 50 to assume a compact configuration as shown in FIG. 6 when the document case is relatively empty. It may be appreciated that the resilient bottom panel 62 may tend to compress the bottom portion of the expandable file module 56 both when the document case 50 is closed and when it is open.

The following method may be used for constructing a document case that embodies the invention such as the document case 10 shown in FIGS. 1 through 3. Provide a first side panel 12 that includes a first exterior surface and an opposing first interior surface of the document case. Provide a second side panel 14 that includes a second exterior surface and an opposing second interior surface of the document case. Couple an expandable file module 16 to the first interior surface and the second interior surface of the document case 10. Provide a flap 18 having a portion of the flap that may be secured adjacent the second exterior surface of the second side panel 14 to close the document case. Couple a top panel 20 to a first edge of the first side panel 12 and an edge of the flap 18. The top panel 20 may be made from a resilient material such that the top panel urges the second side panel 14 toward the first side panel 12 when the flap 18 is secured adjacent the second exterior surface to close the document case 10.

A bottom panel 22 may be coupled to a second edge of the first side panel 12 opposite the first edge and to an edge of the second side panel 14 to hold the coupled edges in a spaced apart relationship. The bottom panel, first side panel, and the second side panel may be formed from a single sheet of material. The single sheet may be folded to form the coupled edges.

In another embodiment as shown in FIGS. 4 and 5, an elastic band 44 may be attached to the document case 30 for coupling the flap 38 to the first side panel 32. The elastic band 44 may be arranged to pass over a second edge of the first side panel 32 opposite the first edge such that the elastic band urges the second side panel 34 toward the first side panel when the elastic band couples the flap 38 to the first side panel. A button 42 may be coupled to the flap 38 to provide a removable coupling for the elastic band 44.

In another embodiment of a document case 50 as shown in FIGS. 6 and 7, a bottom panel 62 may be coupled to a second edge of the first side panel 52 opposite the first edge and to an edge of the second side panel 54. The bottom panel 62 may be made of a resilient material or construction such that the bottom panel urges the second side panel 54 toward the first side panel 52 at the coupled edges.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A document case comprising:

a first side panel that includes a first exterior surface and an opposing first interior surface of the document case;

a second side panel that includes a second exterior surface and an opposing second interior surface of the document case;

an expandable file module coupled to the first interior surface and the second interior surface;

a flap, wherein a portion of the flap may be secured adjacent the second exterior surface to close the document case; and a top panel coupled to a first edge of the first side panel and an edge of the flap, the top panel being resilient such that the top panel urges the second side panel toward the first side panel when the flap is secured adjacent the second exterior surface to close the document case.

2. The document case of claim 1 further comprising a bottom panel coupled to a second edge of the first side panel opposite the first edge and to an edge of the second side panel to hold the coupled edges in a spaced apart relationship.

3. The document case of claim 2 wherein the bottom panel, first side panel, and the second side panel are formed from a single sheet of material with the coupled edges formed by folding the sheet.

4. The document case of claim 1 further comprising an elastic band to couple the flap to the first side panel, the elastic band passing over a second edge of the first side panel opposite the first edge such that the elastic band urges the second side panel toward the first side panel when the elastic band couples the flap to the first side panel.

5. The document case of claim 4 further comprising a button coupled to the flap, wherein the elastic band is coupled to the first side panel, and can be removably coupled to the button.

6. The document case of claim 1 further comprising a bottom panel coupled to a second edge of the first side panel opposite the first edge and to an edge of the second side panel, the bottom panel being resilient such that the bottom panel urges the second side panel toward the first side panel at the coupled edges.

7. The document case of claim 1 wherein the expandable file module includes a plurality of interconnected pockets.

8. A method of constructing a document case comprising:

providing a first side panel that includes a first exterior surface and an opposing first interior surface of the document case;

providing a second side panel that includes a second exterior surface and an opposing second interior surface of the document case;

coupling an expandable file module to the first interior surface and the second interior surface;

providing a flap, wherein a portion of the flap may be secured adjacent the second exterior surface to close the document case; and coupling a top panel to a first edge of the first side panel and an edge of the flap, the top panel being resilient such that the top panel urges the second side panel toward the first side panel when the flap is secured adjacent the second exterior surface to close the document case.

9. The method of claim 8 further comprising coupling a bottom panel to a second edge of the first side panel opposite the first edge and to an edge of the second side panel to hold the coupled edges in a spaced apart relationship.

10. The method of claim 9 further comprising forming the bottom panel, first side panel, and the second side panel from a single sheet of material and folding the sheet to form the coupled edges.

11. The method of claim 8 further comprising coupling the flap to the first side pane with an elastic band, the elastic band passing over a second edge of the first side panel opposite the first edge such that the elastic band urges the second side panel toward the first side panel when the elastic band couples the flap to the first side panel.

12. The method of claim 11 further comprising coupling a button to the flap, wherein the elastic band is coupled to the first side panel, and can be removably coupled to the button.

13. The method of claim 8 further comprising coupling a bottom panel to a second edge of the first side panel opposite the first edge and to an edge of the second side panel, the bottom panel being resilient such that the bottom panel urges the second side panel toward the first side panel at the coupled edges.

14. A document case comprising:

first side panel means to provide a first surface of the document case;

second side panel means to provide a second surface of the document case;

expandable file means to provide document storage;

flap means to close the document case; and, resilient top panel means to couple the first side panel means and the flap means and to urge the second side panel toward the first side panel when the flap means is secured to the second side panel means.

15. The document case of claim 14 further comprising bottom panel means to hold the first side panel means and the second side panel means in a spaced apart relationship.

16. The document case of claim 15 wherein the bottom panel means, first side panel means, and the second side panel means are formed from a single sheet of material.

17. The document case of claim 14 further comprising elastic means to couple the flap means to the first side panel means and to urge the second side panel means toward the first side panel means when the elastic means couples the flap means to the first side panel means.

18. The document case of claim 17 further comprising button means to removably couple the flap means to the elastic means.

19. The document case of claim 14 further comprising resilient bottom panel means to urge the second side panel means toward the first side panel means.

20. The document case of claim 14 wherein the expandable file means includes a plurality of interconnected pocket means.

* * * * *